US005494541A

United States Patent [19]

Fujita et al.

[11] Patent Number: 5,494,541

[45] Date of Patent: Feb. 27, 1996

[54] PRODUCTION OF ALUMINUM ALLOY

[75] Inventors: Hironori Fujita; Fumio Nonoyama; Atsushi Danno, all of Aichi, Japan

[73] Assignee: Kabushiki Kaisha Toyota Chuo Kenkyusho, Aichi, Japan

[21] Appl. No.: 182,831

[22] Filed: Jan. 19, 1994

[30] Foreign Application Priority Data

Jan. 21, 1993 [JP] Japan ..... 5-027486

[51] Int. Cl.[6] ..... C22F 1/04

[52] U.S. Cl. ..... 148/561; 148/688; 148/690; 148/692; 148/693; 148/696; 148/697; 148/698; 148/403

[58] Field of Search ..... 148/561, 688, 148/690, 692, 693, 696, 697, 698, 403; 72/373, 374, 700

[56] References Cited

U.S. PATENT DOCUMENTS 5,242,513 9/1993 Kobayashi et al. ..... 148/561

FOREIGN PATENT DOCUMENTS 3-202431 9/1991 Japan .
3-204160 9/1991 Japan .
3-267355 11/1991 Japan .
0530844 3/1993 Japan ..... 148/561

*Primary Examiner*—David A. Simmons
*Assistant Examiner*—Robert R. Koehler
*Attorney, Agent, or Firm*—Oblon, Spivak, McClelland, Maier, & Neustadt

[57] ABSTRACT

A process for producing an aluminum alloy in the form of mass includes: preparing as a material to be formed a mixed powder of aluminum and at least one kind of metal or non-metallic substance selected from the elements belonging to Groups 4*a*, 4*b*, 5*a*, 6*a*, 7*a* and 8*a* of the periodic table and boron, or a compact or a cast material formed of the mixed powder; placing the material to be formed in a die, and performing plastic deformation repeatedly on the material to be formed at 100° to 400° in an inert atmosphere while retaining at least part of the material to be formed in a confined state, so as to cause diffusion reaction between phases constituting the material to be formed, thereby forming the quasi-stable phase composed mainly of amorphous phases and/or supersaturated solid solution phases. The simple plastic deformation alone gives rise to an aluminum alloy which has the quasi-stable phase (such as amorphous phases and supersaturated solid solution phases) and which is in the form of a mass having a shape similar to that of a finished product.

7 Claims, 7 Drawing Sheets

○ Al
X Ti
● Al SUPER SATURATED SOLID SOLUTION PHASE
△ QUASI-STABLE PHASE [1] ($Al_5Ti_2$)
◎ QUASI-STABLE PHASE [2] ($Al_{23}Ti_9$)
□ STABLE PHASE ($Al_3Ti$)

600°C HEATING

500°C HEATING

450°C HEATING

400°C HEATING

350°C HEATING

AS FORGED
40
50
60
70
80
2θ

PRODUCTION OF ALUMINUM ALLOY

BACKGROUND OF THE INVENTION

1. Field of the Invention

The present invention relates to a process for producing an aluminum alloy having a high strength high hardness, and high heat resistance which warrant its use in many industrial fields including automobiles, aircrafts and electric machines and equipment.

2. Description of the Related Art

There is a great demand for high-strength aluminum alloys with high specific strength in the fields of automobiles, aircrafts, and office equipment, because they are expected to exhibit high performance when used for rapid moving parts. For this reason, many attempts have been made to produce them by rapid cooling or mechanical alloying. In fact, rapid cooling has realized an amorphous material (in the form of 0.02 mm thick ribbon) having a tensile strength in excess of 100 kgf/mm$^2$ by melt spinning from a molten alloy of aluminum, a transition metal (e.g., Fe, Co, and Ni), and a rare earth element (e.g. , Y, La, and Ce) . (See Nippon Kinzoku Gakkaishi, vol. 30, No. 5, 1991, p.375.) Rapid cooling has also realized a material (in the form of mass) having a tensile strength of 100 kgf/mm $^2$ by extrusion at above the phase transformation temperature from an amorphous powder produced by rapidly solidifying an alloy of aluminum and a transition metal (Japanese Patent Laid-Open No. 202431/1991).

On the other hand, mechanical alloying is used to form an amorphous phase from an aluminum powder mixed with a powder of titanium, nickel, niobium, or zirconium in a widely varied ratio by mechanical mixing, grinding, and aggregation which are combined together. (No data is available on the strength of material in the form of mass produced by mechanical alloying.) Mechanical alloying has been used to finely disperse iron particles into aluminum. The resulting material has a tensile strength higher than 55 kgf/mm$^2$ after rolling.

The aluminum alloy obtained by mechanical alloying is available usually in the form of powder having a particle diameter of several micrometers to tens of micrometers. The aluminum alloy obtained by rapid cooling is available in the form of ribbon having a thickness of about 20 μm. However, it is expensive because it contains a large amount of expensive rare earth elements. Aluminum alloys in the form of powder or ribbon are limited in application areas. If an aluminum alloy in the form of amorphous powder is to be made into practical parts, the powder needs consolidation. The consolidation may be accomplished by hot isostatic pressing (HIP) or canning extrusion at 400°–550° in a non-oxidizing atmosphere. The consolidation by these processes involving heating crystallizes the amorphous phase and hence gives rise to an alloy of crystalline structure. Canning extrusion at low temperatures yields an alloy of poor strength due to incomplete bonding between powder particles. In other words, the above-mentioned conventional processes, such as rapid cooling and mechanical alloying, yield an amorphous material in the form of powder or ribbon which has to be processed afterwards into desired products by canning extrusion or the like. For this reason there is a strong demand for an economical and easy process for producing a high-strength amorphous aluminum alloy in the form of mass.

SUMMARY OF THE INVENTION

It is an object of the present invention to provide a simple process for producing by repeated plastic deformation a massive aluminum alloy consisting of a quasi-stable phase composed mainly of amorphous phases and super-saturated solid solution phases.

It is another object of the present invention to provide a process for producing a high-strength aluminum alloy in the form of mass having a tensile strength higher than 70 kgf/mm$^2$ in which the quasi-stable phase of intermetallic compound is finely precipitated.

The present invention is based on the finding that an aluminum alloy in the form of mass can be obtained from a mixture of pure aluminum powder and titanium or vanadium powder by compressing the mixed powder and performing repeated plastic deformation on the compact in a confined space to impart more strain than conventional plastic deformation to the compact. The resulting aluminum alloy in the form of mass consists of the quasi-stable phase composed mainly of amorphous phases and supersaturated solid solution phases. Upon heating at 300°–500°, it exhibits a tensile strength higher than 70 kgf/mm$^2$ due to precipitation of the quasi-stable phase composed mainly of intermetallic compound.

The first aspect of the present invention resides in a process for producing an aluminum alloy in the form of mass, which comprises: preparing as a material to be formed a mixed powder of aluminum and at least one member selected from the group consisting of elements of Groups 4*a*, 4*b*, 5*a*, 6*a*, 7*a* and 8*a* of the periodic table and boron, or a compact or a cast material formed of the mixed powder; placing the material to be formed in a die, and performing plastic deformation repeatedly on the material to be formed at 100°–400° C. in an inert atmosphere which retaining at least part of the material to be formed in a confined state, so as to cause diffusion reaction between phases constituting the material to be formed, thereby forming the quasi-stable phase composed mainly of the amorphous phases and/or supersaturated solid solution phases.

The process of the present invention yields an aluminum alloy in which the quasi-stable phase composed mainly of the amorphous phases and/or the supersaturated solid solution phases is formed by repeated plastic deformation alone. The resulting aluminum alloy is in the form of mass having a desired shape close to that of the finished part.

To form the amorphous phase and/or supersaturated solid solution phase, the process includes: forming a material to be formed from a mixed powder of aluminum and at least one member selected from the group consisting of elements of Groups 4*a*, 4*b*, 5*a*, 6*a*, 7*a* and 8*a* of the periodic table and boron; and placing the material to be formed in a die, and performing plastic deformation repeatedly on the material to be formed at 100°–400° C. in an inert atmosphere while retaining at least part of the material to be formed in a confined state, so as to cause diffusion reaction between phases in the material to be formed.

The following is the probable reason why the above-mentioned process gives rise to the amorphous phase and/or supersaturated solid solution phase.

In the case of the compact, for example, the deformation causes powder particles to attrite and crush each other to activate their surface, bringing about the diffusion reaction between powder particles. Repeated plastic deformation forms new active surfaces, causing the diffusion to proceed. After repeated plastic deformation, the diffusion eventually proceeds to such an extent that particles in the material to be formed are bonded to each other. In this way it is possible to form a solid solution (or a quasi-stable phase) in which elements are dissolved in such a large amount that cannot be attainable by the ordinary heat treatment or forging.

While the process of the present invention is based on the same principle as the conventional mechanical alloying to form the amorphous phase by diffusion, it has the following significant difference.

Mechanical alloying resorts to ball milling at normal temperature for 10–1000 hours for attrition, crushing, and aggregation of particles, which eventually form the quasi-stable phase due to diffusion between particles. The resulting material is always in the form of powder. This powder has an active surface but the activity slightly decreases with time due to adsorption of inert atmospheric gas and formation of compounds on the surface. Therefore, the solidification of the powder needs canning extrusion or hot isostatic pressing (HIP) at high temperatures (450°–600° C.) in a vessel.

By contrast, according to the process of the present invention, an alloy in the form of mass can be formed at low temperatures (100°–400° C.) by performing repeated plastic deformation on the material to be formed so as to cause diffusion between metal particles due to attrition and crushing with high energy-, thereby forming the quasi-stable phase, and bonding metal particles firmly to each other by the effect of high pressure and surface activity. The process should preferably be carried out in a high vacuum or an inert gas atmosphere (e.g., argon) to maintain the activity of the new surface formed by crushing and to protect the active surface from oxidation and nitriding, because deactivated surface does not permit diffusion between metal particles.

In the case of cast material, a stable phase composed mainly of comparatively large particles of an intermetallic compound dispersed therein is subjected to repeated plastic deformation to activate the interface of the stable phase due to attrition and crushing. The crushed stable phase reacts with the aluminum matrix to give rise to the quasi-stable phase. The quasi-stable phase is deemed to be formed by diffusion between particles which is caused by high energy. The maximum rate of diffusion is obtained at an elevated deforming temperature, which is also desirable to reduce the resistance to deformation of the material to be formed. An adequate deforming temperature ranges from 100° C. to 400° C. Plastic deformation at an excessively high temperature tends to form an equilibrated phase due to diffusion between particles. Moreover, the quasi-stable phase turns into the stable phase when it is kept at a high temperature.

The process of the present invention permits the production of an aluminum alloy having the quasi-stable phase by the repeated plastic deformation which is comparatively easy to carry out. The resulting aluminum alloy is in the form of mass (having a shape close to that of a finished product) instead of powder or ribbon. Therefore, it is free from difficulties involved in handling powder and it obviates the step for solidification.

The second aspect of the present invention resides in a process for producing a high-strength aluminum alloy in the form of mass, which comprises: preparing as a material to be treated a mixed powder of aluminum and at least member selected from the group consisting of elements of Groups 4*a*, 4*b*, 5*a*, 6*a*, 7*a* and 8*a* of the periodic table and boron, or a compact or a cast material formed of the mixed powder; placing the material to be formed in a die, and performing plastic deformation repeatedly on the material to be formed at 100°–400° C. in an inert atmosphere while retaining at least part of the material to be formed in a confined state, so as to cause diffusion reaction between phases constituting the material to be formed, thereby forming the quasi-stable phase composed mainly of the amorphous phases and/or supersaturated solid solution phases; and heating the material to be formed at 200°–500° C., thereby finely dispersing the quasi-stable phase and/or the stable phase composed mainly of intermetallic compounds.

Thus, the process of the present invention is characterized in that the quasi-stable phase composed mainly of the amorphous phases and/or the supersaturated solid solution phases is formed by repeated plastic deformation and the quasi-stable phase and/or the stable phase composed mainly of intermetallic compounds is finely dispersed by the subsequent heat treatment, thereby producing a high-strength aluminum alloy.

The following is the probable reason why the above-mentioned heat treatment gives rise to a high-strength aluminum alloy. When an aluminum alloy containing the quasi-stable phase undergoes heat treatment at 200°–500° C., the alloy elements collect in the aluminum alloy matrix from the amorphous phases and supersaturated solid solution phases. This yields the structure in which are finely dispersed the quasi-stable phase and stable phase composed mainly of intermetallic compounds, and this structure contributes to giving a high strength. The high strength is maintained even at high temperatures of 200°–500° C., because the elements in the aluminum alloy of this invention have a comparatively low rate of diffusion in aluminum and hardly form the stable phase. By contrast, such alloy elements as copper, zinc, and magnesium, which are commonly used for the conventional aluminum alloys, rapidly disperse at above 200° C. and the finely dispersed phases aggregate in a short time to form the stable phase of large particles.

The process of the present invention permits the production of a high-strength aluminum alloy in which the quasi-stable phase and/or the stable phase composed mainly of intermetallic compounds is finely dispersed. This process is easily accomplished by forming the alloy into a shape close to that of the finished product while it is still soft and then heating the formed aluminum alloy.

These and other objects, features, and advantages of this invention will become more apparent from the following description and the accompanying drawings.

DETAILED DESCRIPTION OF THE INVENTION

Figure 1A:
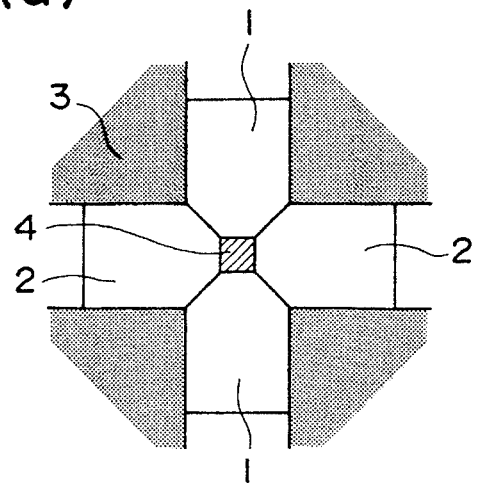
FIGS. 1(*a*) to 1(*c*) are schematic diagrams showing the repeated plastic deformation by cross-shaped compression.

The process of the present invention starts with mixing aluminum powder with one or more elements which readily form the quasi-stable phase such as the amorphous phase, supersaturated solid solution phase, and intermetallic compound. The elements should preferably be those which precipitate the quasi-stable phase or stable phase composed mainly of intermetallic compound to be finely dispersed in the aluminum alloy matrix after heat treatment and remains to be fine particles without aggregation at a high temperature. They are selected from Groups 4*a*, 4*b*, 5*a*, 6*a*, 7*a* and 8*a* of the periodic table and boron. For the aluminum alloy to have an improved high-temperature strength, it is necessary to finely disperse the precipitated particles and prevent their aggregation and growth. To this end, it is desirable to add elements which are relatively slow in diffusion in aluminum. Preferred examples of such elements include titanium, chromium, vanadium, cobalt and iron.

The aluminum alloy of this invention differs from the conventional high-strength aluminum alloy such as Al—Cu alloy and Al—Zn—Mg alloy. The disadvantage of the latter is that fine particles grow at the heat treatment temperature above 180° C. because the alloy elements (Cu, Zn, and Mg) have a high rate of diffusion in aluminum. The activation energy for diffusion of these elements is about 20 to 35 kcal/mol, whereas that of Cr, Ti, Fe, Co, etc. is about 40–58 kcal/mol. This indicates that the latter elements are slow in diffusion. It has been pointed out that an aluminum alloy having an improved high-temperature strength is obtained by heating the supersaturated solid solution of the elements which are slow in diffusion. However, it has been difficult to form a supersaturated solid solution in which such elements are dissolved in large quantities. The present inventors succeeded in forming the quasi-stable phase of supersaturated solid solution from these elements by the above-mentioned process. The amount of these alloy elements should be in the range of 0.5% to 20% (in atomic ratio). All or part of these alloy elements form the quasi-stable phase of amorphous phases or supersaturated solid solution phases. With an amount less than 0.5%, the alloy elements are not enough in strengthening. With an amount in excess of 20%, the alloy elements account for a large portion of the dispersed particles, decreasing the toughness of the resulting alloy.

According to the process of the present invention, the quasi-stable phase is formed by repeating plastic deformation which crushes aluminum powder and alloy metal powder or the phases in the aluminum alloy, forms fresh surfaces, and causes diffusion across interfaces. The process is carried out in an inert atmosphere to effectively bring about diffusion and to keep interfaces clean. In addition, the process is carried out at temperatures higher than 100° C. but below the temperature at which the stable phase is formed, so as to facilitate plastic deformation and diffusion.

The repeated plastic deformation should be performed under sufficient load so that the phases in the material to be formed undergo attrition, crushing, interface activation, and diffusion for bonding, regardless of whether the material to be formed is formed from a mixture of aluminum powder and metal powder or from a cast aluminum alloy in which the stable phase is dispersed. The plastic deformation brings about diffusion across interfaces and forms the quasi-stable phase. The plastic deformation should be repeated several tens of times with a stress higher than 40 kg/mm$^2$ (or higher than the yield strength of the aluminum alloy) for crushing and interface activation. The desired stress is 60–200 kg/mm$^2$ in view of the friction with the die and the breakage of the die.

The repeated plastic deformation may be carried out by one of the following methods.

Figure 1B:
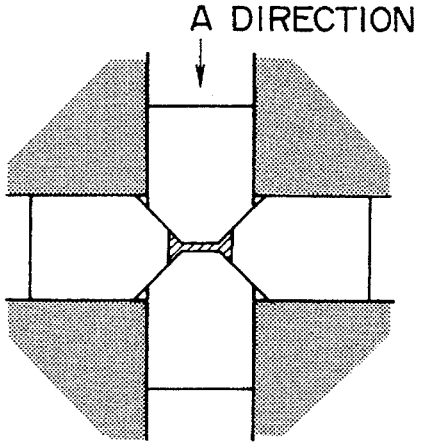
Figure 1C:
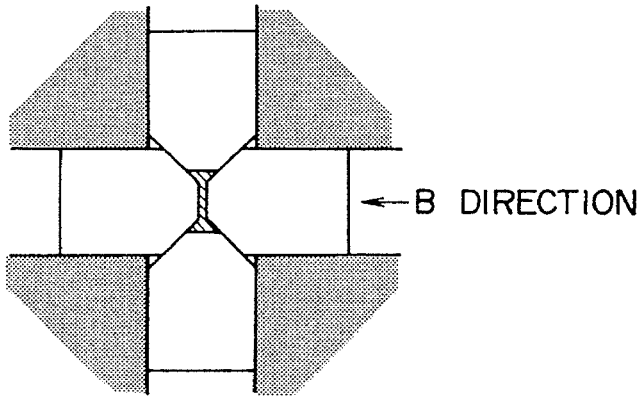
Figure 2A:
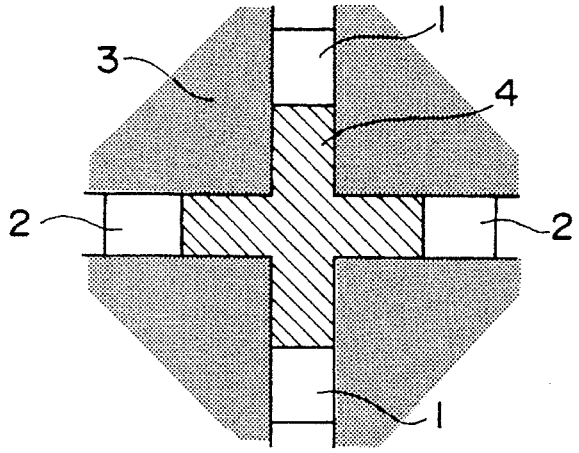
FIGS. 2(*a*) to 2(*c*) are schematic diagrams showing the repeated plastic deformation by closed cross-shaped compression.
Figure 2B:
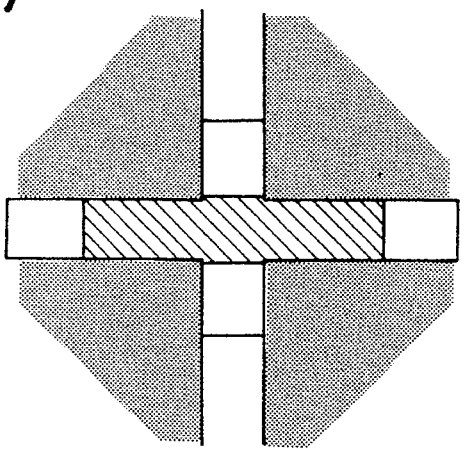
Figure 2C:
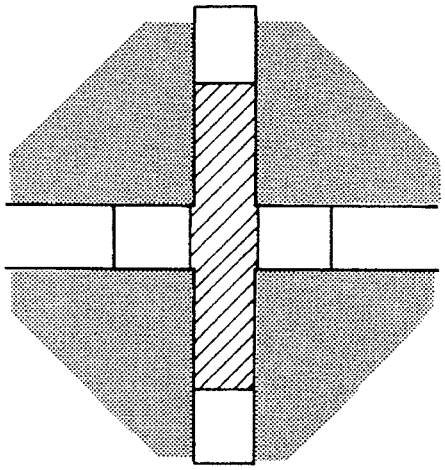

(1) Cross-shaped compression:

This method employs a device consisting of a die and movable plungers which are provided at right angles to ,each other (i.e. up and down, and right and left), as shown in FIGS. 1 (*a*) to 1 (*c*). This device is operated by the aid of a press or the like. To start operation, the material to be formed is placed at the center of the die. Then, the plungers 1 are moved vertically (in the direction A) under load to compress the material to be formed. A portion of the material to be formed is squeezed out to push away the plungers 2 horizontally. The plungers 2 are moved horizontally (in the direction B) under load to compress the material to be formed. These operations are repeated for plastic deformation. The alternate vertical and horizontal movements of the plungers greatly deform the material to be formed. A disadvantage of this method is that the material to be formed may be subject to cracking as the cavity in the die changes in volume. This disadvantage can be overcome by using a device of closed type, as shown in FIGS. 2(*a*) to 2 (*c*), which keeps the volume of the cavity almost constant. In the latter case, it is desirable to provide a mechanism which interlinks the advancing plungers with the retreating plungers.

Figure 3:
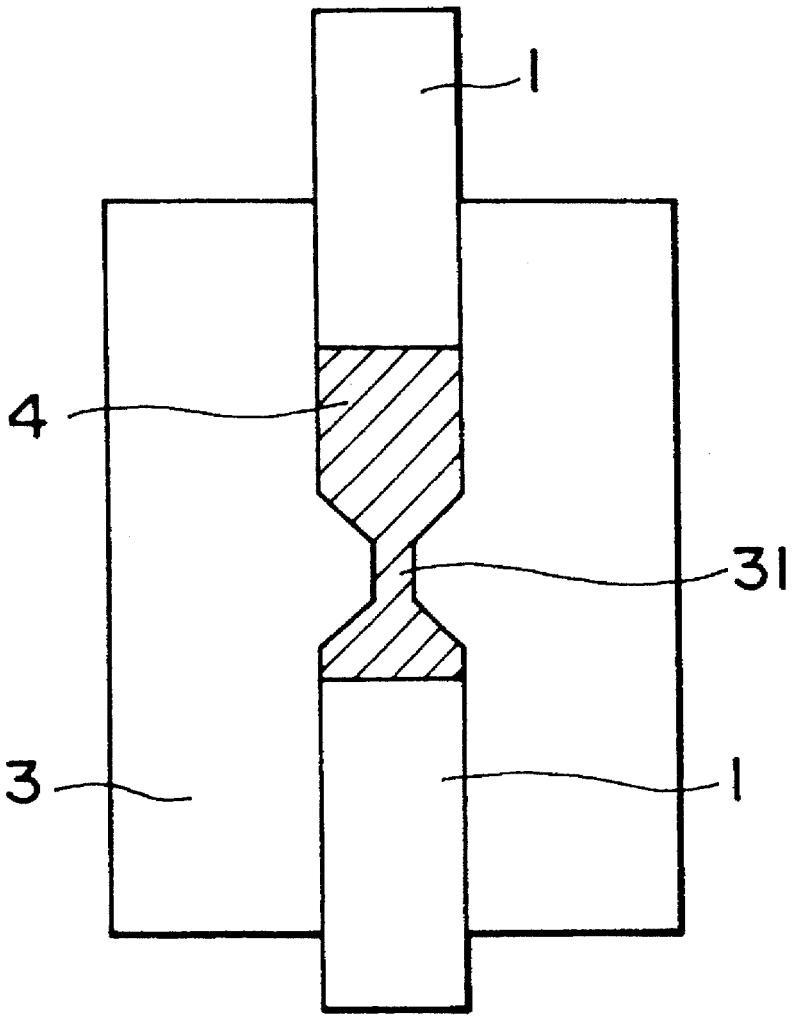
FIG. 3 is a schematic diagram showing the repeated plastic deformation by extrusion.

(2) Extrusion:

This method employs a device as shown in FIG. 3. The material to be formed is placed between the two plungers 1. As the plungers reciprocate, the material to be formed is forced through the narrow orifice 31 up and down. When the upper plunger 1 moves downward under load, the lower plunger 1 also moves downward while keeping the confined volume of the cavity. Thus the extruded material to be formed expands under the orifice. This method permits severe plastic deformation. In addition, this method causes no cracking to the material to be formed owing to the closed extrusion which keeps the volume of the cavity almost constant.

(3) Rotary forging:

This method employs a device consisting of a stationary die and a plunger placed above. The material to be formed is placed at the center of the die and undergoes plastic deformation by the plunger which rotates and oscillates. Plastic deformation by a single operation with a small load is limited, but it is easy to repeat operations as many times as required. This method is suitable for large material to be formed.

The invention will be described in more detail with reference to the following examples.

EXAMPLE 1

Pure aluminum powder (finer than 350 mesh) was intimately mixed with pure titanium powder (finer than 350 mesh) in an atomic ratio of 80:20. The mixed powder was formed into a compact (measuring 20 mm long, 8.2 mm wide, and 8.5 mm high, and weighing 4.1 g) by compression at about 200 kgf/cmusing a hydraulic press. The compact was placed at the center of the cavity of the device shown in FIG. 1(*a*). The material to be formed and die was heated to 300° C. in an electric furnace under an argon stream at a flow rate of 1–3 l/min for preventing oxidation. The die was mounted on a press capable of pressing the plungers vertically. The material to be formed was pressed by the plungers 1 in the direction A (as shown in FIG. 1(*b*)) until its thickness is reduced to 2 mm, so that a portion of the material to be formed was squeezed out sideward. With the die turned through 90°, the sample was pressed again by the plungers 2 in the direction B (as shown in FIG. 1(*c*)) until its thickness is reduced to 2 mm. The above-mentioned procedure was repeated 120 times. The peak value of pressing load was initially about 10 tons; but it gradually increased with the repetition of operations and finally reached 38 tons. This value is equivalent to about 110 kgf/mm$^2$. After the repeated operations, the die temperature decreased to 190° C.

The material to be formed was discharged by disassembling the die. It was found that the sample is composed of firmly bonded particles although it has :some cracks on its surface. Microscopic examination of the cross section revealed that the sample in the form of mass ha:B no cracking and impurities inside.

Figure 4B:
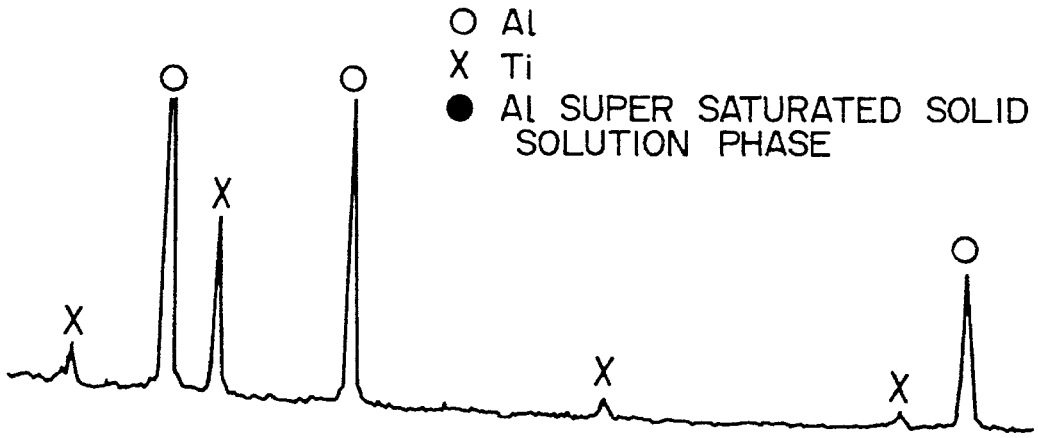
FIGS. 4(*a*) and 4(*b*) are the result of X-ray diffraction performed on the sample in Example 1 before and after the repeated plastic deformation by cross-shaped compression.
Figure 4A:
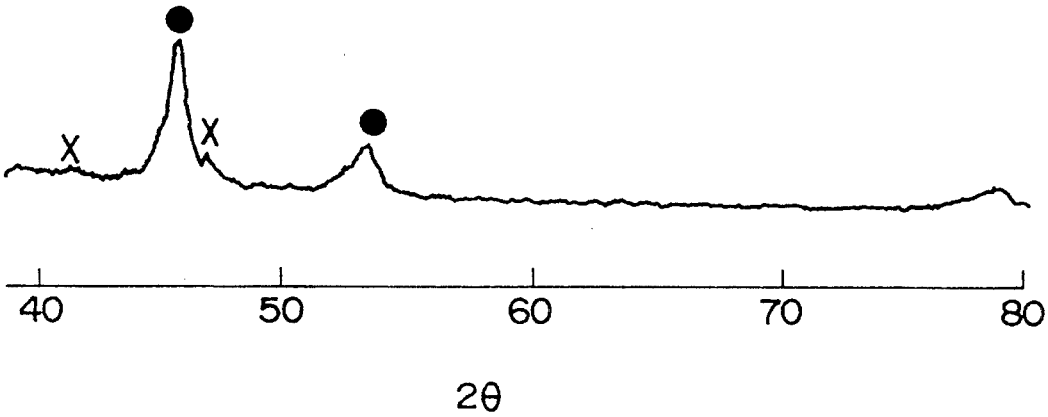
Figures 5A, 5B, 5C, 5D, 5E, 5F:
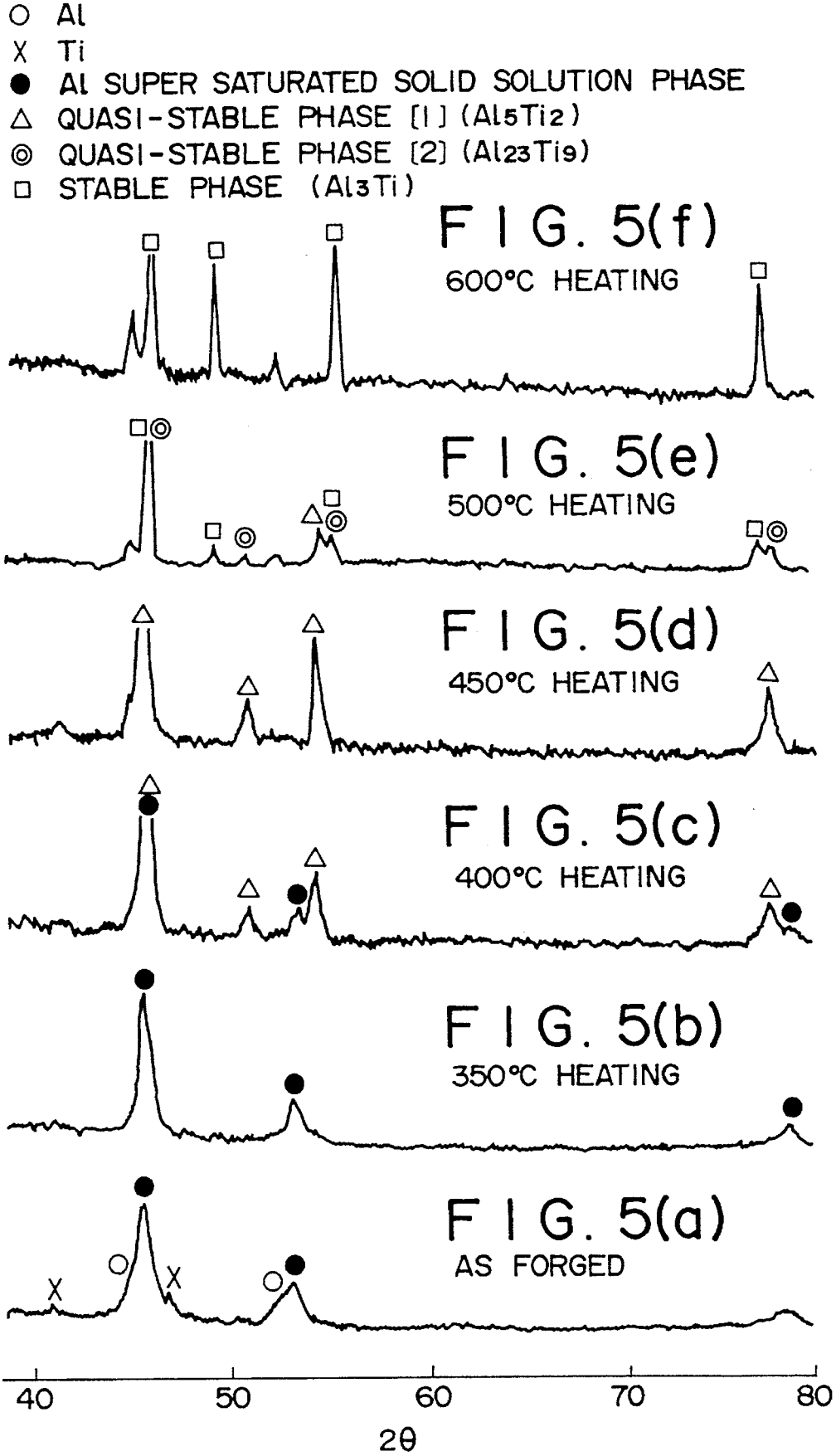
FIGS. 5(*a*) to 5(*f*) are the result of X-ray diffraction performed on the sample in Example 1 which was heated at 350° C., 400° C., 450° C., 500° C., and 600° C., after the repeated plastic deformation by cross-shaped compression.
Figure 6:
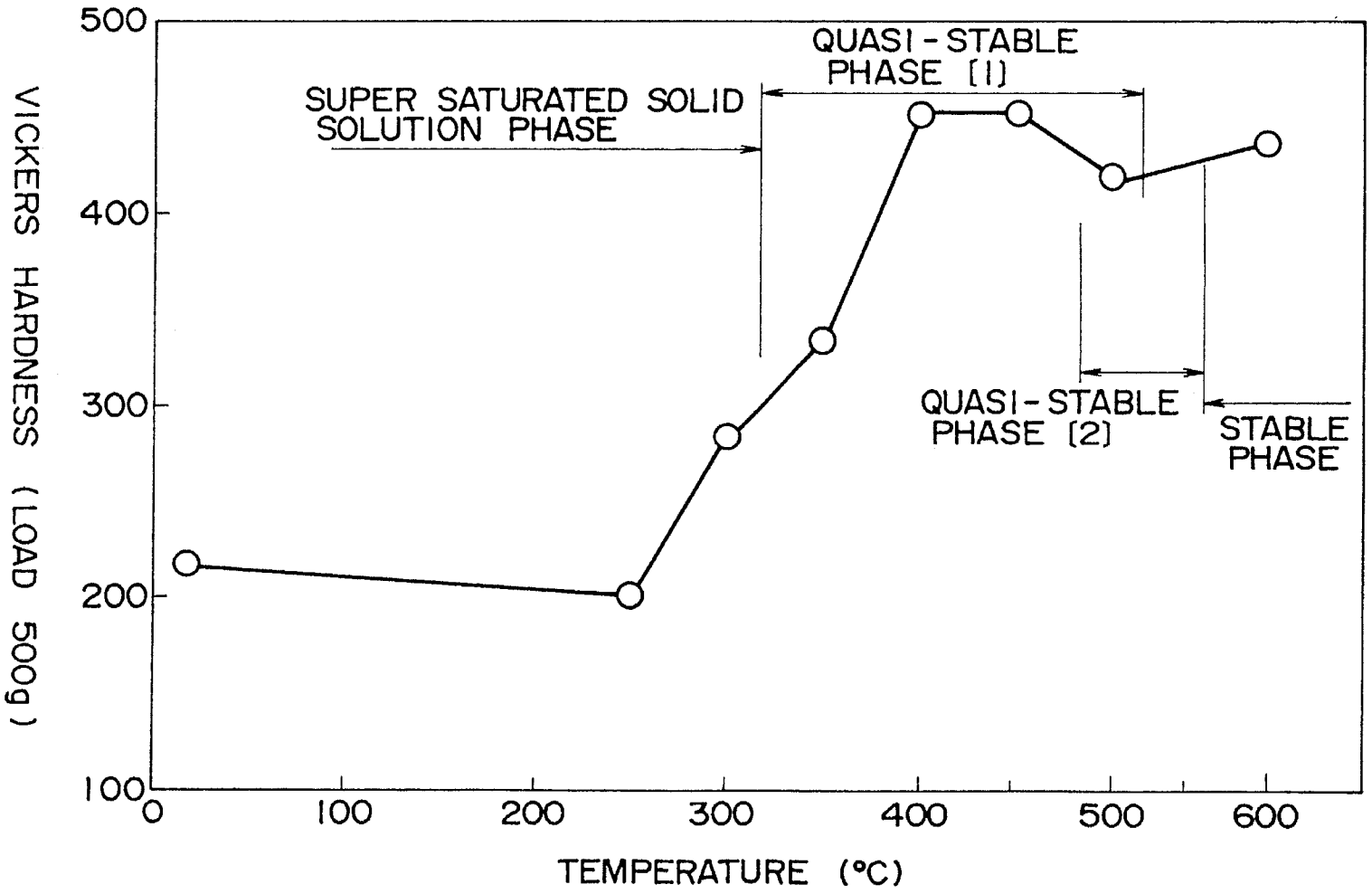
FIG. 6 shows the relationship between the heat treatment temperature and the Vickers hardness of the sample in Example 1 which underwent the repeated plastic deformation by cross-shaped compression.

This sample gave an X-ray diffraction pattern as shown in FIG. 4 (*a*), which indicates that the sample is an aluminum alloy of face-centered cubic structure containing supersaturated solid solution of about 20 atomic titanium %. This result is significant in view of the fact that the maximum amount of titanium that can be dissolved in aluminum by the conventional rapid cooling method is only 0.2 atomic% . The material to be formed before plastic deformation gave an X-ray diffraction pattern as shown in FIG. 4 (*b*), which indicates that the sample is a mere mixture of pure aluminum and pure titanium. A portion of the sample which underwent repeated plastic deformation was tested for X-ray diffraction and hardness at room temperature after heating (for aging) at 350° C., 400° C., 450° C., 500° C., and 600° C. for 1 hour each in an argon stream. The results are shown in FIGS. 5(*a*) to 5(*f*) and 6, from which the following are noted. The sample without aging (FIG. 5 (*a*)) has the supersaturated solid solution phase of aluminum in which titanium is dissolved, and it has a hardness of Hv 230. After aging at 350° C., the sample (FIG. 5(*b*)) has the quasi-stable phase [1] of $Al_5Ti_2$. After aging at 500° C., the sample (FIG. 5(*e*)) has the quasi-stable phase of [2] $Al_{23}Ti_9$ and a maximum hardness of Hv 470. After aging at 600° C., the sample (FIG. 5 (*f*)) has the stable phase of $TiAl_3$ and it cracks when pressed by the indenter.

This example demonstrates that the repeated plastic deformation yields an aluminum alloy in the form of mass having the quasi-stable phase in which a large amount of titanium is dissolved. Such an aluminum alloy has never been produced by the prior technology. The aluminum alloy greatly increases in hardness upon heating.

EXAMPLE 2

Pure aluminum powder (finer than 350 mesh) was intimately mixed with pure chromium powder (finer than 350 mesh) in an atomic ratio of 80:20. The mixed powder was formed into a sample, which underwent repeated plastic deformation 150 times in a die at 300° C., in the same manner as in Example 1. It was found that the resulting sample is composed of firmly bonded particles although it has some cracks on its surface.

Figure 7B:
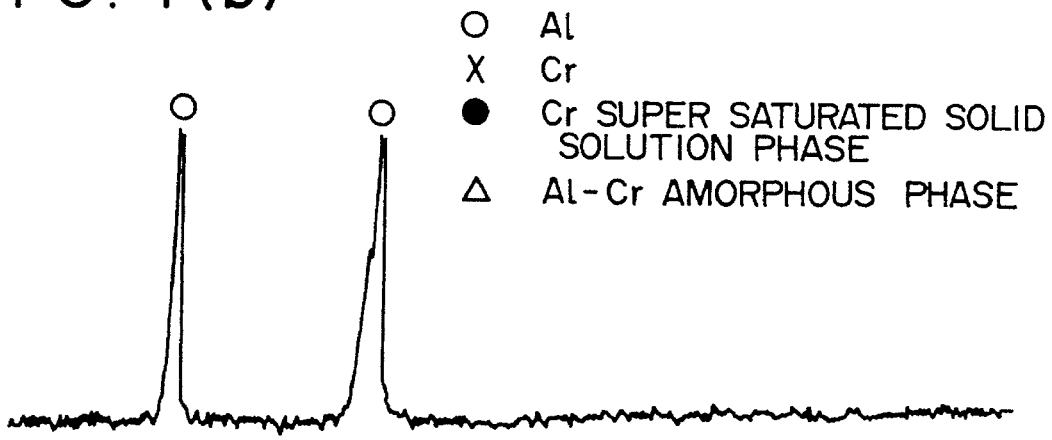
FIGS. 7(*a*) and 7(*b*) are the result of X-ray diffraction performed on the sample in Example 2 before and after the repeated plastic deformation by cross-shaped compression.
Figure 7A:
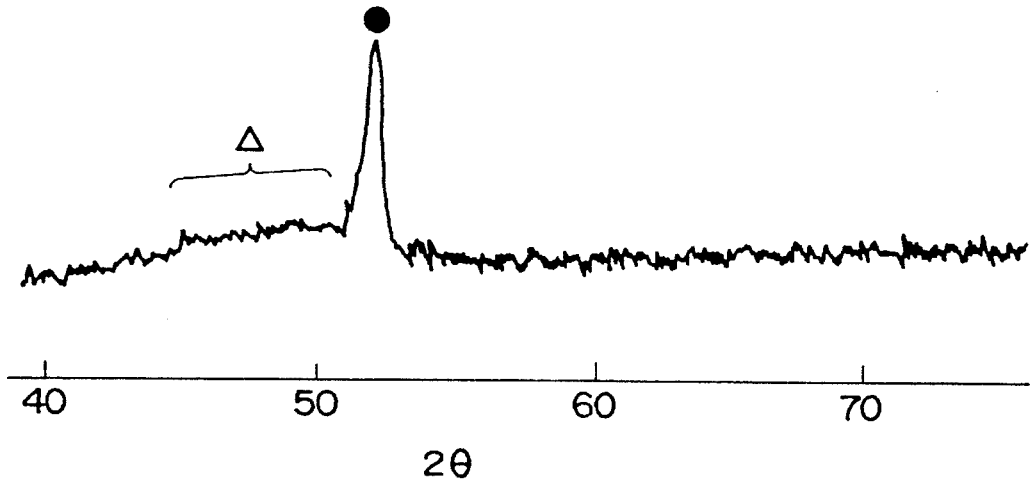

This sample gave an X-ray diffraction pattern as shown in FIG. 7(*a*), which indicates that the sample is an aluminum alloy composed of an amorphous phase of aluminum and chromium and a chromium alloy in which aluminum is dissolved. The material to be formed before plastic deformation gave an X-ray diffraction pattern as shown in FIG. 7(*b*), which indicates that it is a mere mixture of pure aluminum and pure chromium.

EXAMPLE 3

Pure aluminum powder was mixed with $Al_3V$ alloy such that vanadium accounts for 10% (in atomic ratio). The mixed powder was melted in a vacuum and the melt was rapidly solidified. The resulting sample was compressed to a thickness of 1 mm repeatedly 360 times using a die kept at 300° in the same manner as in Example 1. The sample gave an X-ray diffraction pattern due to aluminum and amorphous phase. This indicates that the quasi-stable phase was formed by the decomposition of the stable phase ($Al_3V$). This process is referred to as mechanical grinding.

EXAMPLE 4

Pure aluminum powder was mixed with pure titanium powder such that titanium accounts for 10% (in atomic ratio). The mixed powder was formed into a compact (weighing 5.4 g) by pressing. The compact underwent plastic deformation repeatedly 300 times using a die kept at 300° C. in the same manner as in Example 1. The sample was discharged by disassembling the die. It was found that the sample in the form of mass is composed of firmly bonded particles and it has no cracks on its surface. This sample contains a phase of pure aluminum and a phase of supersaturated solid solution of aluminum in which titanium is dissolved. It has a hardness of Hv 120 and a tensile strength of 38 kgf/mm$^2$ at room temperature.

The sample was made into a specimen for tensile test. The specimen was heated (for aging) at 400° C. for 1 hour in an argon stream and then tested for X-ray diffraction, hardness, and tensile strength at room temperature. It was found that this aging forms the quasi-stable phase of $Al_5Ti_2$ (which is an intermetallic compound) and increases the hardness to Hv 250 and the tensile strength to 75 kgf/mm$^2$.

EXAMPLE 5

The same mixed powder as in Example 1 was prepared. The mixed powder was formed into a cylindrical compact measuring 15 mm in diameter and 25 mm high. The compact was placed in an extrusion die as shown in FIG. 3. With the die and plungers lubricated with graphite and the die heated to 300° C., the material to be formed was extruded downward by the plunger under a load of 28 tons (160 kgf/mm$^2$). With the device inverted, the material to be formed was extruded again. In this way extrusion was repeated 60 times. Thus there was obtained a sample of aluminum alloy in the form of mass free from cracking. The examination by X-ray diffraction revealed that the sample contains a phase resembling the phase of pure aluminum and a phase of supersaturated solid solution of aluminum in which titanium is dissolved.

EXAMPLE 6

Pure aluminum powder (finer than 350 mesh) was intimately mixed with pure titanium powder (finer than 350 mesh) and pure iron powder (finer than 350 mesh) in an atomic ratio of 90:5:5. The mixed powder was compressed into a compact, which was subsequently underwent repeated plastic deformation 120 times by compression to a thickness of 2 mm using a die kept at 300° C. in the same manner as in Example 1. The alloy sample discharged from the disassembled die was a mass composed of firmly bonded particles although it had some cracks on its surface.

The resulting alloy sample gave an X-ray diffraction pattern having no peaks due to pure titanium and pure iron as the raw materials. Its magnetic properties indicate that it consists of the phase of aluminum solid solution in which titanium and iron are dissolved. Upon heating at 400° C. for 1 hour, the hardness of the alloy increased from Hv 170 to Hv 240. The same result as mentioned above was obtained in experiments in which pure iron was replaced by silicon or copper.

What is claimed is:

1. A process for producing an aluminum alloy having at least partly therein a quasi-stable phase, comprising:

preparing a composition comprising a mixed powder of aluminum and at least one member selected from the group consisting of elements of Groups 4*a*, 4*b*, 5*a*, 6*a*, 7*a* and 8*a* of the periodic table and boron, or a compact or a cast article formed of said mixed powder;

placing said composition in a closed die, and performing repeated plastic deformation at 100° C. to 400° C. in an inert atmosphere wherein said plastic deformation simultaneously causes a diffusion reaction between phases constituting said composition and consolidates said composition into a mass, thereby forming the quasi-stable phase composed mainly of amorphous phases and/or supersaturated solid solution phases.

2. A process for producing an aluminum alloy having at least partly therein a quasi-stable phase, comprising:

preparing a composition comprising a mixed powder of aluminum and at least one member selected from the group consisting of elements of Groups 4*a*, 4*b*, 5*a*, 6*a*, 7*a* and 8*a* of the periodic table and boron, or a compact or a cast article formed of said mixed powder;

placing said composition in a closed die, and performing repeated plastic deformation at 100° C. to 400° C. in an inert atmosphere wherein said plastic deformation simultaneously causes a diffusion reaction between phases constituting said composition and consolidates said composition into a mass, thereby forming the quasi-stable phase composed mainly of amorphous phases and/or supersaturated solid solution phases; and heating said composition at 200° C. to 500° C., thereby finally dispersing a quasi-stable phase and/or a stable phase composed mainly of intermetallic compounds.

3. A process as defined in claim 1 or 2, wherein said at least one member is selected from the group consisting of titanium, chromium, vanadium and iron.

4. A process as defined in claim 1 or 2, wherein the amount of said at least one member is in the range of 0.5 to 20 atomic %.

5. A process as defined in claim 1 or 2, wherein the quasi-stable phase is formed by compressing said composition repeatedly for plastic deformation in a cavity by two sets of paired plungers, one set being arranged perpendicular to the other, said cavity being surrounded by the trapezoidal ends of the four plungers, with the trapezoid having sides inclined 45 degrees with respect to the top, said plungers being constructed such that when the first set of paired plungers compresses said composition, the material to be formed is squeezed out of the cavity to push away the second set of paired plungers.

6. A process as defined in claim 1 or 2, wherein the quasi-stable phase is formed by extruding said composition repeatedly for plastic deformation through a narrow orifice in a cavity by paired plungers, said plungers being constructed such that when one plunger compresses said composition, the other plunger retreats while maintaining the constant volume of the cavity.

7. A process as defined in claim 1 or 2, wherein the quasi-stable phase is formed by compressing said composition entirely for plastic deformation by a plunger which rotates and oscillates to apply local flow force in said composition placed at the center of a stationary lower die.

* * * * *